US009527222B2

(12) United States Patent
Koike

(10) Patent No.: US 9,527,222 B2
(45) Date of Patent: Dec. 27, 2016

(54) METHOD FOR MANUFACTURING DIAGONAL PLYWOOD

(75) Inventor: Masaru Koike, Aichi (JP)

(73) Assignee: Meinan Machinery Works, Inc., Obu-shi (JP)

( * ) Notice: Subject to any disclaimer, the term of this patent is extended or adjusted under 35 U.S.C. 154(b) by 1215 days.

(21) Appl. No.: 13/484,470

(22) Filed: May 31, 2012

(65) Prior Publication Data

US 2012/0325371 A1 Dec. 27, 2012

(30) Foreign Application Priority Data

Jun. 23, 2011 (JP) ..... 2011-139094

(51) Int. Cl.
*B27D 1/04* (2006.01)

(52) U.S. Cl.
CPC ..... *B27D 1/04* (2013.01)

(58) Field of Classification Search
CPC ..... B27D 1/00; B27D 1/04; B27D 1/10; B27D 5/003; B27D 5/006; B27M 3/0013; B27M 3/002; B27M 3/0026; B27M 3/006; B27M 3/0066; B27M 3/0093; B27M 3/04; B27M 1/08
USPC ..... 144/363, 367, 345, 346, 350
See application file for complete search history.

(56) References Cited

U.S. PATENT DOCUMENTS 5,662,760 A * 9/1997 Tsuda ..... 156/264
7,384,675 B2 6/2008 Ohata
2006/0032579 A1 2/2006 Ohata
2006/0275574 A1* 12/2006 Cable ..... 428/58
2008/0121334 A1* 5/2008 Ohata ..... 156/71
2009/0000730 A1* 1/2009 Bosson ..... 156/264

FOREIGN PATENT DOCUMENTS

JP 49-034270 U 3/1974
JP 07001596 A * 1/1995

OTHER PUBLICATIONS

European Search Report dated Oct. 10, 2012, issued for corresponding EPO application No. 12171119.6.

* cited by examiner

*Primary Examiner* — Matthew G Katcoff
(74) *Attorney, Agent, or Firm* — Locke Lord LLP

(57) ABSTRACT

Method for manufacturing diagonal plywood is disclosed. The method uses a rectangular-shaped plywood board or a joined plywood board made of a plurality of plywood boards having the same thickness and joined together into a rectangular shape is prepared. The rectangular-shaped board or joined board is cut diagonally with respect to any pair of parallel sides of the board along diagonal parallel lines spaced at a predetermined interval into a plurality of cut boards having a shape of parallelogram or trapezoid. Subsequently, the cut boards are joined together side-to-side into a joined elongated board in such a way that the opposite parallel sides thereof form the elongated sides of the resulting joined elongated board. The joined elongated board is cut across the elongated sides thereof into a plurality of rectangular-shaped boards of any desired dimension.

5 Claims, 13 Drawing Sheets

METHOD FOR MANUFACTURING DIAGONAL PLYWOOD

The present invention relates to a method for manufacturing diagonal plywood.

Plywood called as diagonal plywood has been known in the art. Diagonal plywood comprises a plurality of layers of veneer glued together generally with the wood grain of veneer of any two adjacent layers extending generally in perpendicular relation to each other and also diagonally with respect to any paired parallel sides of a rectangular shape of the plywood.

A method for manufacturing such plywood is disclosed by the U.S. Pat. No. 7,384,675 and illustrated in the drawings including FIGS. 20, 21 and 22 attached hereto. According to this method, a sheet of veneer 101 peeled by a rotary veneer lathe is clipped or cut along cutting lines 103 that extend along the wood grain (indicated by double-headed arrows) of the veneer 101 and are spaced at a predetermined interval in the direction perpendicular to the grain of the veneer 101 into a plurality of veneer sheets 105 of a rectangular shape, as shown in FIG. 20. Subsequently, a number of such rectangular-shaped veneer sheets 105 are joined together in a side-to-side manner at the sides thereof that correspond the lateral opposite parallel sides of the veneer sheet 101, thereby forming a joined and elongated sheet of veneer 107 whose wood grain is oriented along the lateral opposite parallel sides of the joined elongated veneer sheet 107 formed by the cutting of the veneer sheet 101 and indicated by numeral 103, as shown in FIG. 21.

The joined veneer sheet 107 is cut along cutting lines 109 (FIG. 21) that extend diagonally at about 45° with respect to the lateral opposite parallel sides 103 of the joined veneer sheet 107 and spaced at a predetermined interval in the direction along the parallel sides 103 into a plurality of veneer sheets 111 of a parallelogram shape. Then, a number of such parallelogram-shaped veneer sheets 111 are joined at the sides thereof formed by the cutting of the veneer sheet 101 and indicated by 103, thereby forming a layer of joined veneer 113, as shown in FIG. 22, and plural such layers of joined veneer 113 are laminated one on another in such a way that the wood grains of veneer in any two adjacent layers 113 are oriented in perpendicular relation to other as indicated by double-headed arrows shown in FIG. 22, into a veneer laminated board. Cutting off irregular triangular ends from the laminated board, a board of diagonal plywood is made.

According to the method disclosed by the above-cited Publication, however, no machinery and equipment in existing veneer and plywood mills can be used for making the above-described layers of joined veneer 113 and for laminating such layers of joined veneer 113 together into the veneer laminated board from which diagonal plywood is made. For manufacturing the diagonal plywood disclosed by the above-identified patent, a new plant need be made and hence a large investment is required.

Additionally, manufacturing and preparing rectangular-shaped sheets of veneer such as 105, joined veneer such as 107, parallelogram-shaped veneer such as 111, layers of joined veneer 113 and the lamination of the layers of joined veneer 113 are extremely troublesome, time consuming and hence costly. Thus, the method for manufacturing the diagonal plywood disclosed in the above-cited Publication is inefficient.

The present invention, which has been made in light of the above-identified problems, is directed to providing a method for manufacturing diagonal plywood that permits the use of existing machinery and equipment in a plywood mill.

SUMMARY

The method of manufacturing diagonal plywood according to the present invention uses a rectangular-shaped plywood board having a plurality of layers of veneer laminated together or a joined plywood board made by joining a plurality of plywood boards of similar structure and having substantially the same thickness into a rectangular shape is prepared. Then, such rectangular-shaped board or joined board is cut diagonally with respect to any pair of parallel sides of the board along diagonal parallel lines spaced at a predetermined interval into a plurality of cut boards having a shape of parallelogram or trapezoid. Subsequently, the cut boards are joined together in a side-to-side manner into a joined elongated board in such a way that the opposite parallel sides of the cut boards that are generated by the cutting of the rectangular plywood board or joined plywood board form the elongated sides of the resulting joined elongated board. The joined elongated board is cut across the elongated sides thereof into a plurality of rectangular-shaped boards of any desired dimension.

Alternatively, the parallelogram- and trapezoid-shaped board may be converted by cutting into rectangular-shaped boards and such boards are then joined together into the joined elongated board from which rectangular-shaped boards are cut.

Features and advantages of the present invention will become more apparent to those skilled in the art from the following description of embodiments of the invention, which description is made with reference to the accompanying drawings, wherein:

DETAILED DESCRIPTION OF THE PREFERRED EMBODIMENT

The following will describe the first preferred embodiment of the method for manufacturing diagonal plywood according to the present invention with reference to FIGS. 1 through 8.

Figure 1:
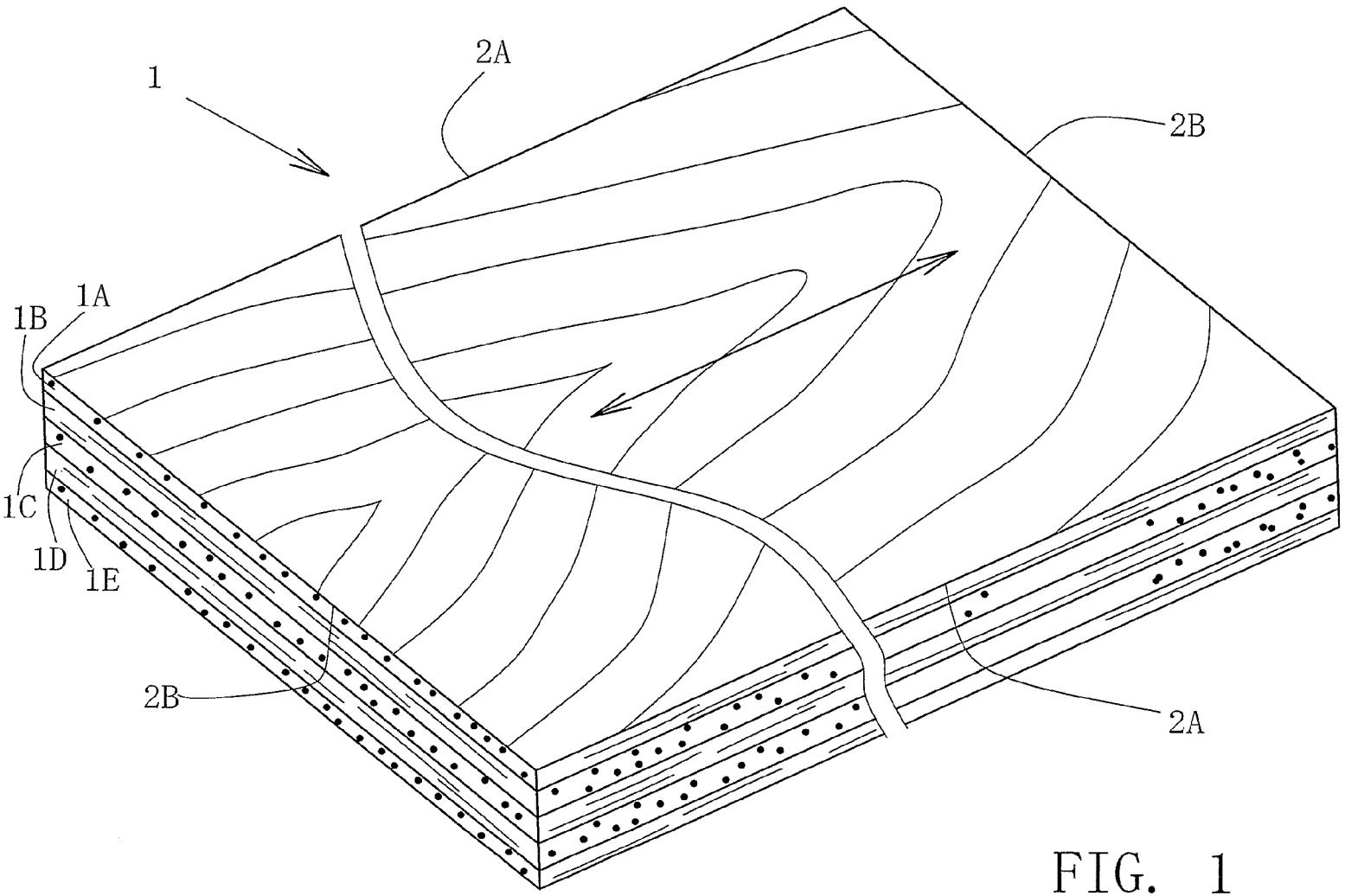
FIG. 1 is a perspective broken view of a plywood board having a rectangular shape.

Referring firstly to FIG. 1, there is shown in a perspective broken view a plywood board 1 having five layers of veneer 1A, 1B, 1C, 1D and 1E laminated together by adhesive with the wood grain of any two adjacent layers of veneer oriented generally in perpendicular relation to each other. The plywood board 1 has a predetermined thickness and a rectangular shape with two parallel opposite long sides 2A extending along the grain of the face veneer sheet 1A that is indicated by double-headed arrow and two parallel opposite short sides 2B extending across the grain of the face veneer sheet 1A.

Figure 2:
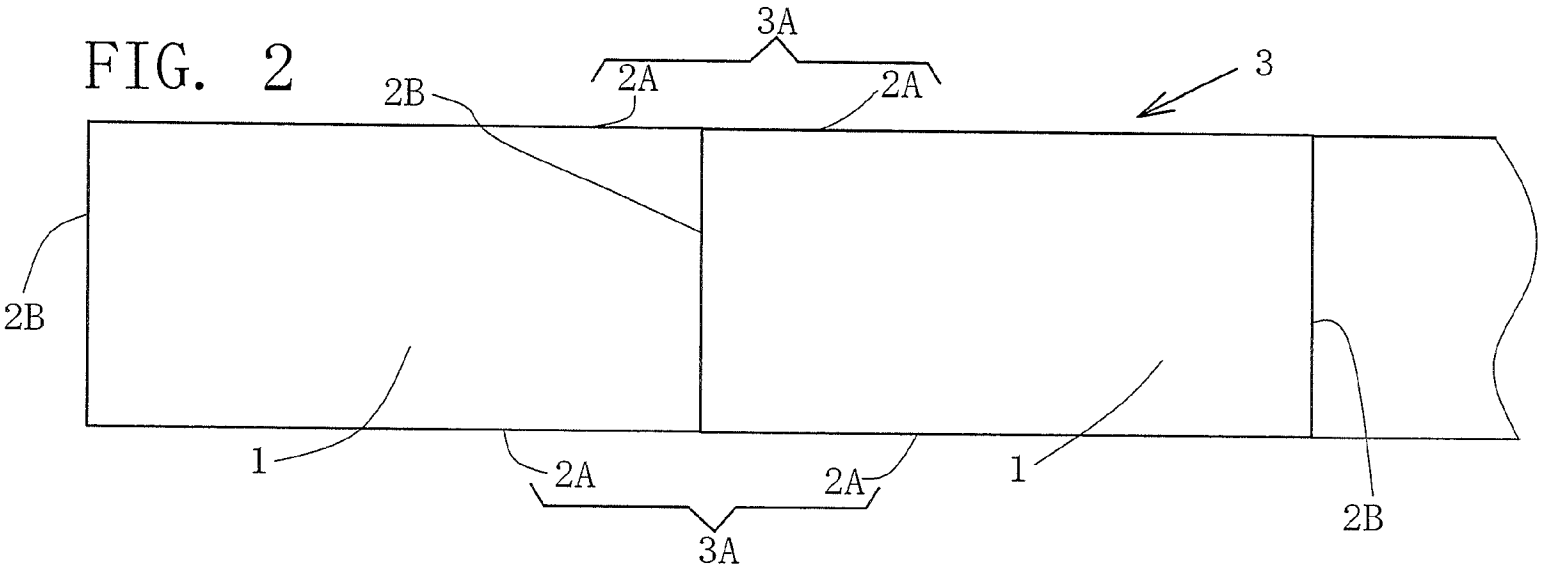
FIGS. 2 and 3 are schematic plan views of a joined and elongated board made by joining a plurality of plywood boards of FIG. 1, showing two different steps in the method for manufacturing diagonal plywood according to a first preferred embodiment of the present invention.

In the first step for manufacturing diagonal plywood according to the first embodiment, a plurality of such plywood boards 1 is provided or prepared and then joined together in a side-to-side manner at the short sides 2B thereof into a first joined elongated board 3 having a rectangular shape, as shown in FIG. 2. For this purpose, the plywood boards 1 are joined with the parallel long sides 2A thereof aligned with each other, respectively. In joining the plywood boards 1, the opposite surfaces of the boards 1 are formed flush with each other, respectively, as shown in FIGS. 4 and 5.

Figure 4:
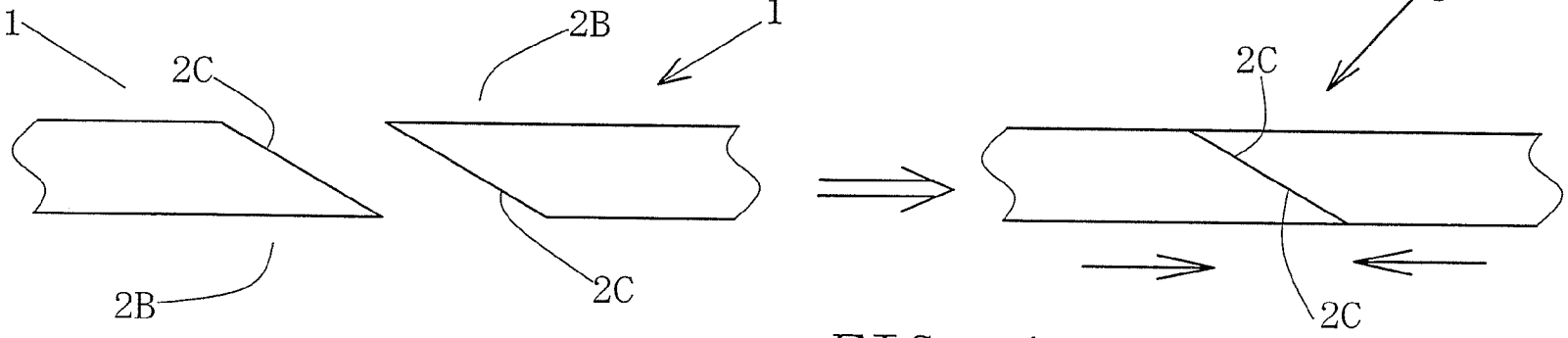
FIGS. 4, 5 and 6 are schematic views showing examples of joining plywood boards in the step illustrated in FIG. 2.
Figure 5:
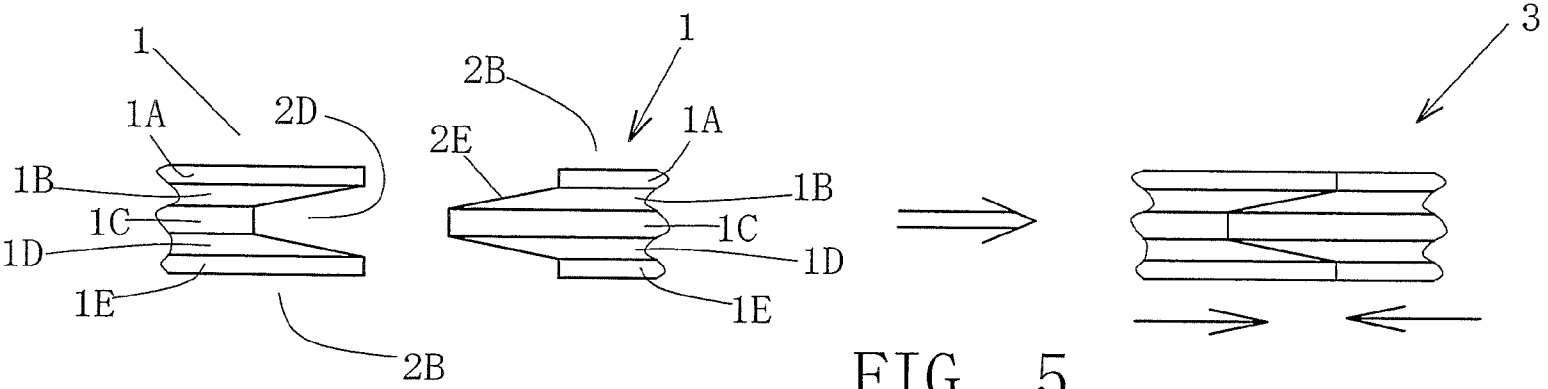
Figure 6:
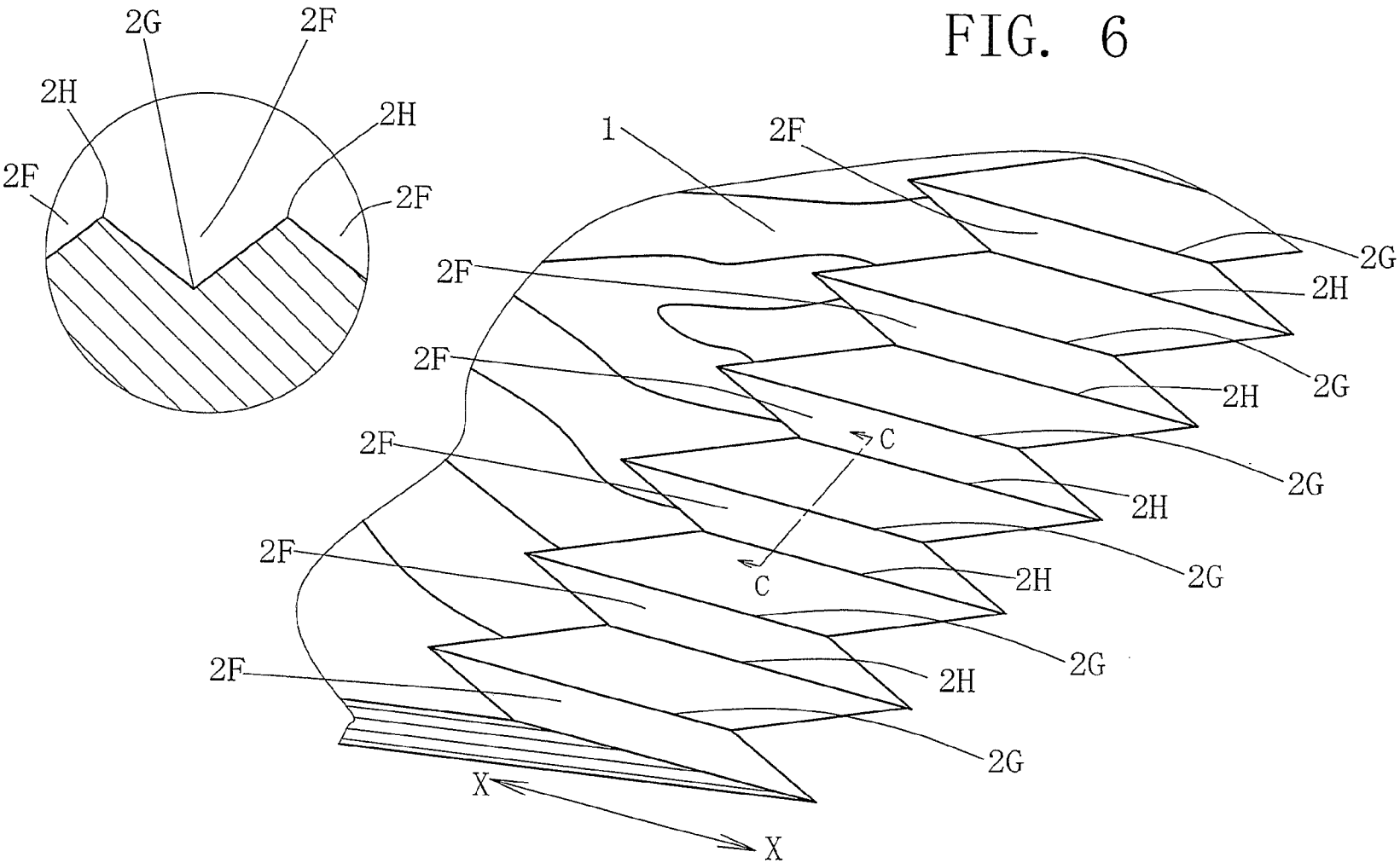

The joining may be accomplished in various ways as exemplified in FIGS. 4, 5 and 6. According to the joining of FIG. 4, firstly the opposite short sides 2B of plywood board 1 are cut by a circular saw thereby to form scarf cuts or beveled surfaces 2C extending in the same direction or parallel to each other at an inclined angle as shown in the drawing. Adhesive is applied to one of the beveled surfaces 2C of each plywood board 1 and the plywood boards 1 are lapped one on another at the beveled surfaces 2C into an elongated board. Joining may be completed by allowing the adhesive through the application of heat.

Alternatively, the plywood boards 1 may be joined by tong-and-groove joint, as shown in FIG. 5. Each plywood board 1 is formed at the opposite short sides 2B thereof with a groove 2D and a tongue 2E of complementary shapes by using a cutter, as shown in FIG. 5. Plywood boards 1 having adhesive applied to either one of the groove 2D and the tongue 2E are assembled and joined together at the short sides 2B thereof into the first joined board 3. As mentioned above, the plywood boards 1 are arranged with the opposite surfaces thereof flush each other in the resulting joined board 3, respectively, as shown in FIGS. 4 and 5.

Still another joint that is called sloped-finger joint may be utilized. In this method, the opposite short sides 2B of the plywood board 1 are firstly formed with beveled surfaces such as 2C of FIG. 4. In the case of the sloped-finger joint, the beveled surfaces are formed at the opposite ends 2B so as to extend in opposite directions. Then, a plurality of parallel V-shaped grooves 2F is cut along the inclination of the beveled surface, as indicated by double-headed arrow A-A in FIG. 6, so as to extend to the bottom or the opposite surface of the plywood board 1. As shown in the encircled cross-section taken along C-C of FIG. 6, each V-shaped groove 2F has a crest 2H and a bottom 2G. Two sloped-finger joints inclined in opposite direction with respect to one surface of the board are formed at the opposite short sides 2B of the respective plywood boards 1. In joining any two plywood boards 1, one of the plywood boards 1 is turned upside down and combined so that the crests 2H of the V-shaped grooves 2F of one plywood board 1 are engaged snugly with the bottoms 2G of the V-shaped grooves 2F of the other plywood board 1. Joining of the plywood boards 1 may be accomplished by curing adhesive applied to the V-shaped grooves 2F of at least one of the two plywood boards 1.

Figure 3:
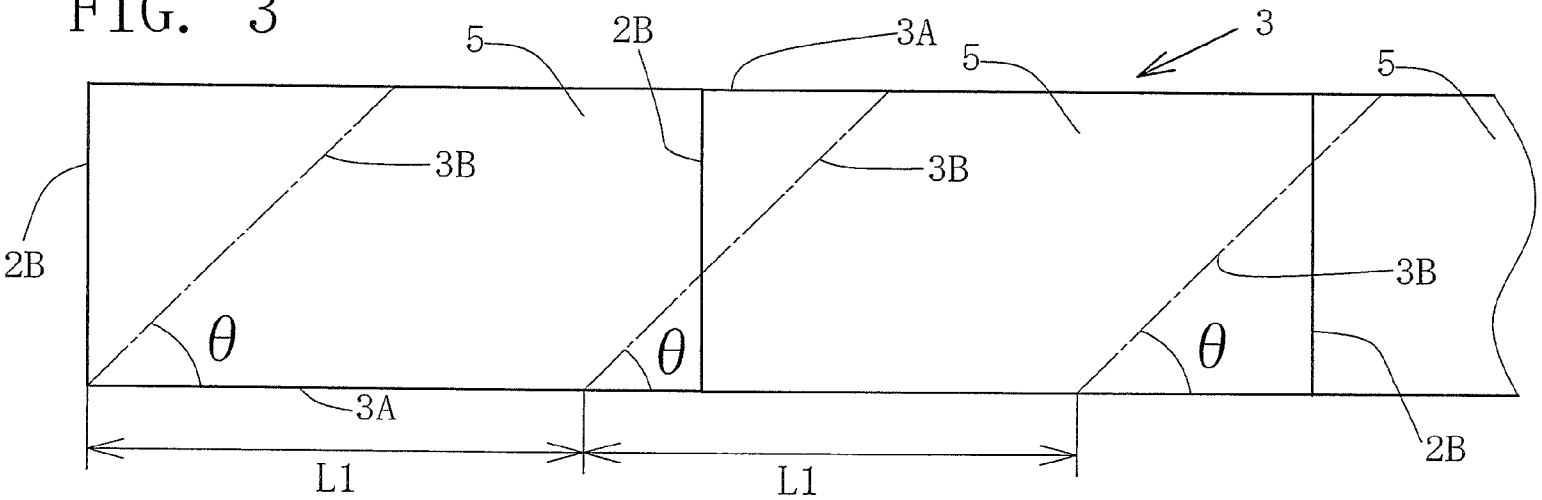

In the next step for manufacturing diagonal plywood, the first joined elongated board 3 is cut by a circular saw (not shown) along lines 3B indicated by dashed-dotted lines in FIG. 3 that extend at an angle θ of about 45° with respect to the parallel opposite long sides 3A of the joined board 3 and are spaced at a predetermined interval L1 in the direction of the parallel long sides 3A, into a plurality of cut boards 5 each having a parallelogram shape, as shown in FIG. 3.

Figure 7:
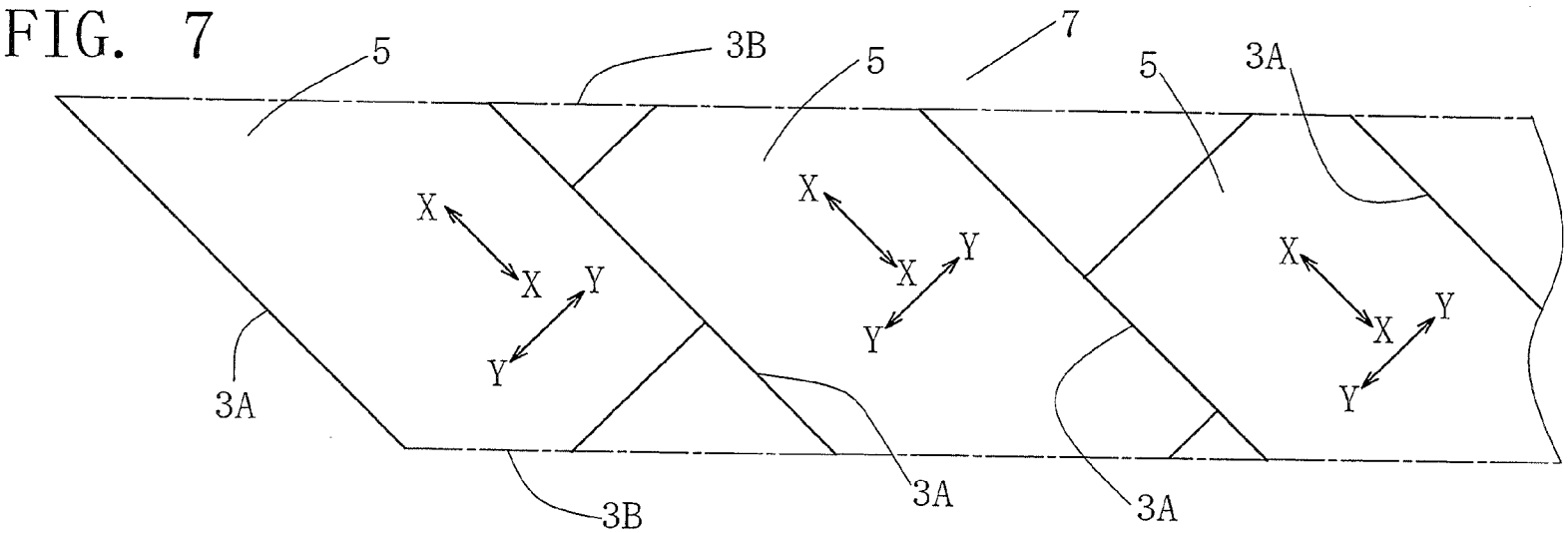
FIGS. 7 and 8 are schematic plan views showing two different steps in the method for manufacturing diagonal plywood according to the first preferred embodiment.

Subsequently, the cut boards 5 are joined together in a side-to-side manner at the sides thereof corresponding to the long sides 3A of the joined elongated board 3 with the other parallel opposite sides (indicated by 3B) thereof generated by the cutting of the first joined board 1 aligned with each other, respectively, into a second joined elongated board 7, as shown in FIG. 7. As in the case of joining the plywood boards 1, the cut boards 5 are joined together with the opposite surface thereof formed flush, respectively. Any suitable joint described with reference to FIGS. 4, 5 and 6 may be used for the joining of the cut boards 5. In FIG. 7, double-headed arrows X-X and Y-Y indicate the grain directions of component veneer sheets of the second joined board 7. It is noted that, for ease of understanding of the present invention, the parallel opposite long sides of the second joined board 7 in FIG. 7 are shown by dashed-dotted lines that corresponds to the cutting lines 3B in FIG. 3.

Figure 8:
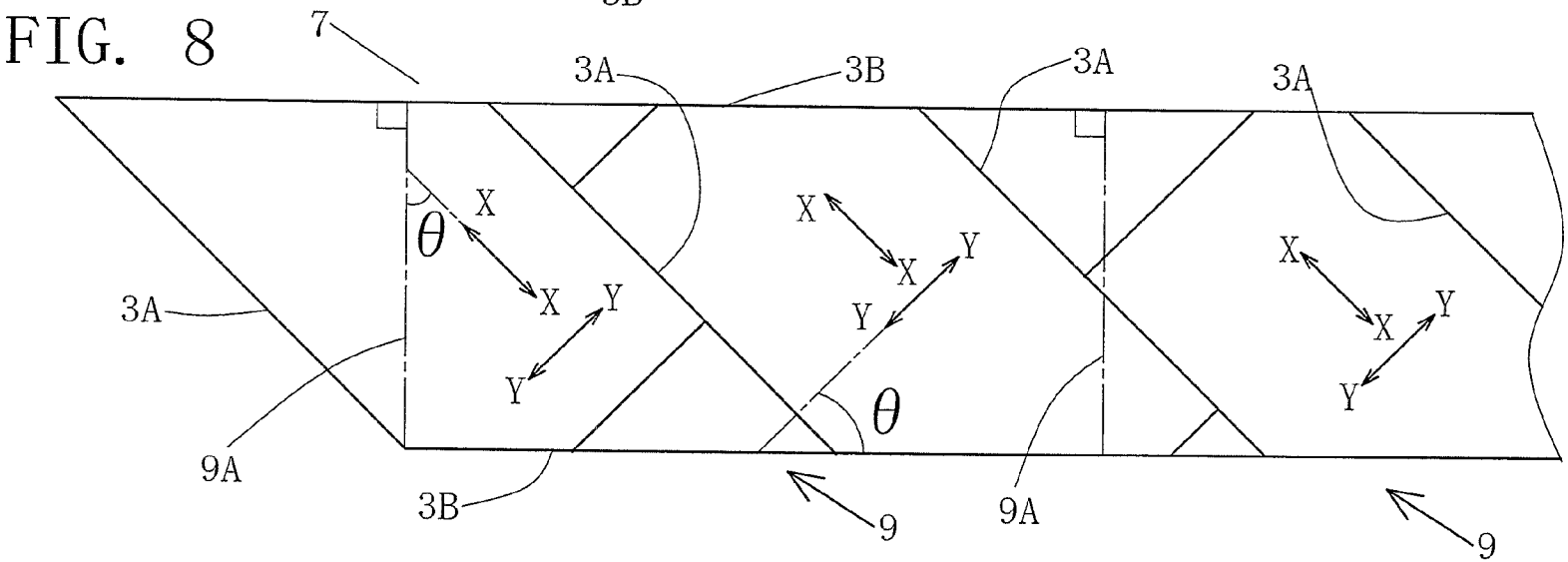

Using a circular saw (not shown), the second joined board 7 is cut along lines 9A that extend perpendicularly to the opposite parallel long sides of the second joined board 7 (indicated by 3B that designates the cutting lines in FIG. 3) and are spaced at any desired interval, into a plurality of boards 9 of diagonal plywood each having a rectangular shape, as shown in FIG. 8. In FIG. 8, double-headed arrows X-X and Y-Y indicate the wood grain directions of component veneer sheets of the resulting board 9 diagonal plywood. As shown in the drawing, these wood grain directions X-X and Y-Y of the diagonal plywood boards 9 extend at the aforementioned angle θ of about 45° with respect to the parallel opposite long sides (indicated by 3B) of the board 9 and intersect each other at an angle of 90°.

As is apparent to those skilled in the art, according to the above-described method of the first preferred embodiment of the present invention, diagonal plywood can be manufactured using plywood boards produced by existing machinery and equipment in a plywood mill. Therefore, the investment required for manufacturing diagonal plywood can be reduced greatly as compared to the case of manufacturing the diagonal plywood manufactured by the method according to the above-cited prior art. Additionally, the method according above embodiment of the present invention is advantageous in that plywood boards can be cut and joined more efficiently than veneer sheets and, therefore, diagonal plywood may be produced efficiently by using the method according to the embodiment of the invention.

According to the present invention, the plural plywood boards 1 need not be identical in plane figure. That is, the plywood boards 1 may have different dimensions for the long sides 2A. Additionally, though the plural plywood boards 1 should preferably of the same structure in terms of the number layers of veneer and the thickness of the respective layers, the plywood boards 1 need not be identical in such structure.

The following will described a second embodiment of the present invention with reference to FIG. 9 through 13. The second embodiment differs from the first embodiment in that a single plywood board may be used for making cut boards and also that a diagonal plywood board with a reduced width may be manufactured.

Figure 9:
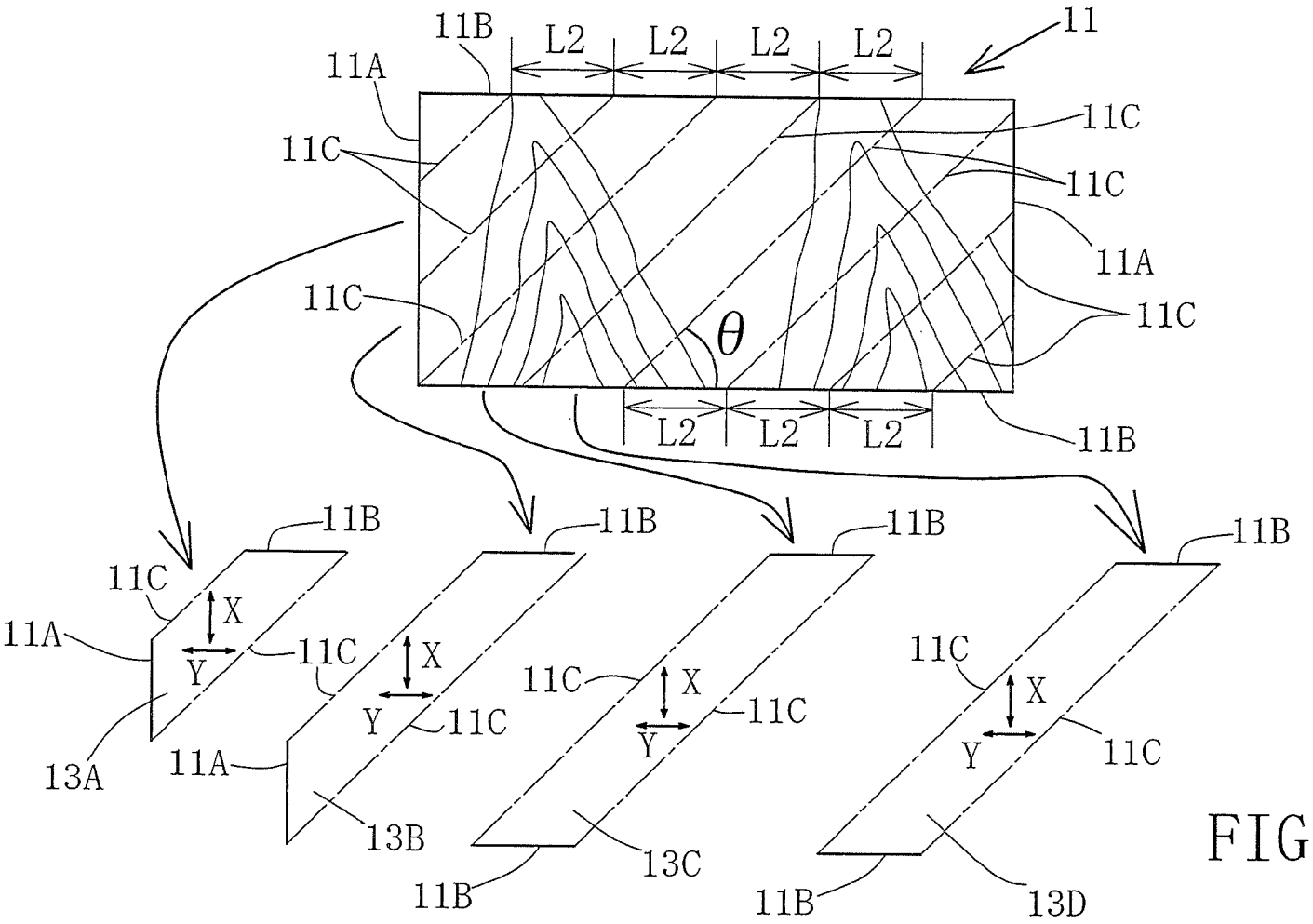
FIGS. 9 through 13 are schematic plan views showing various steps in the method for manufacturing diagonal plywood according to second and third preferred embodiments of the present invention.

FIG. 9 shows a plywood board 11 for use in the second embodiment. The plywood board 11 may be of the same five-ply configuration as the plywood boards 1 which are used in the first embodiment. As shown in the drawing, the plywood board 11 has parallel opposite short side 11A and parallel opposite long sides 11B and, unlike the plywood board 1 of FIG. 1, the wood grain of the outer layers of veneer, e.g. the face and back veneer sheets, of the plywood board 11 extends generally along the short sides 11A.

In the first step of the method for manufacturing diagonal plywood according to the second embodiment, the plywood board 11 is cut by using a circular saw (not shown) along diagonal lines 11C that extend at an angle θ of about 45° with respect to the long sides 11B of the plywood board 11 and are spaced at a predetermined interval L2 in the direction along the long sides 11B, into a plurality of cut boards such as 11A, 11B, 11C, 11D, 11E and so forth each having a band shape, as shown in FIG. 9. Specifically, the cut boards 11A, 11B are trapezoid shaped, while the boards 11C, 11D are parallelogram shaped.

Figure 10:
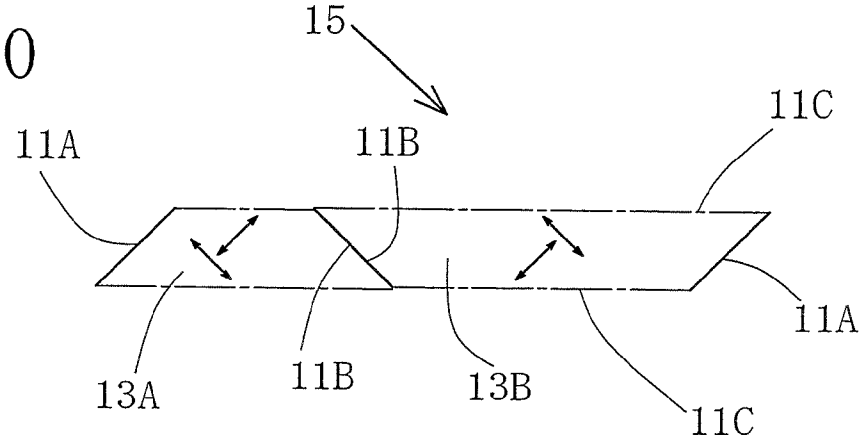
Figure 11:
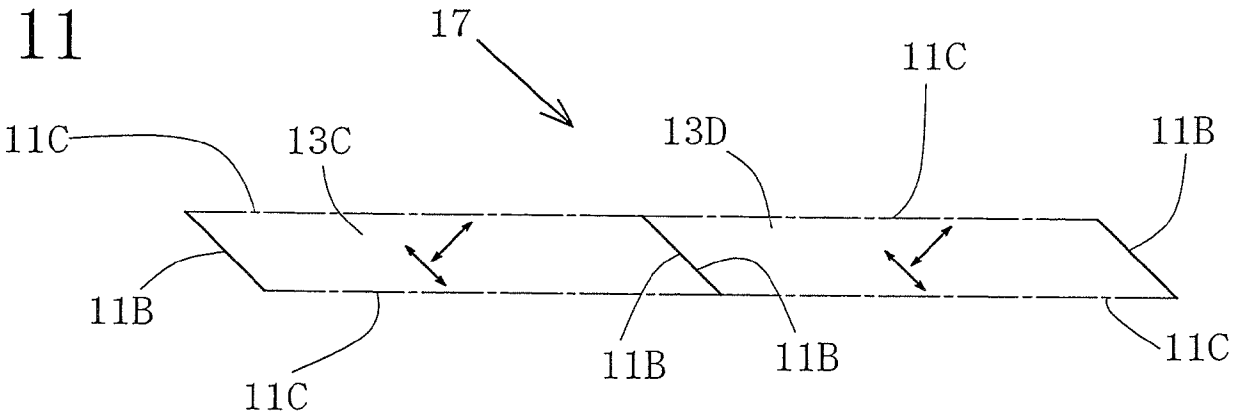

Trapezoid-shaped boards such as 13A, 13B and so forth are jointed together by any suitable joint in a side-to-side manner at the sides thereof indicated by 11A and 11B in FIG. 9 into a joined elongated board 15, as shown in FIG. 10. The joining is done with the parallel opposite sides of the trapezoid-shaped boards 11C, or the sides generated by the cutting of the plywood board 11 and indicated by 11C, aligned with each other, respectively, and the opposite surfaces of the resulting joined board 15 formed flush, respectively. On the other hand, parallelogram-shaped boards such as 13C, 13D and so forth are joined together by any suitable joint in a side-to-side manner at the sides thereof corresponding to the parallel sides 11B of the plywood board 11 and indicated by 11B, into a joined elongated board 17, as shown in FIG. 11. As in the case of joining of the trapezoid-shaped boards 13A, 13B, the boards 13C, 13D are joined with the parallel opposite sides thereof generated by the cutting of the rectangular plywood board 11 and indicated by 11C aligned with each other, respectively, and the opposite surfaces of the resulting joined board 17 formed flush with each other, respectively.

Figure 12:
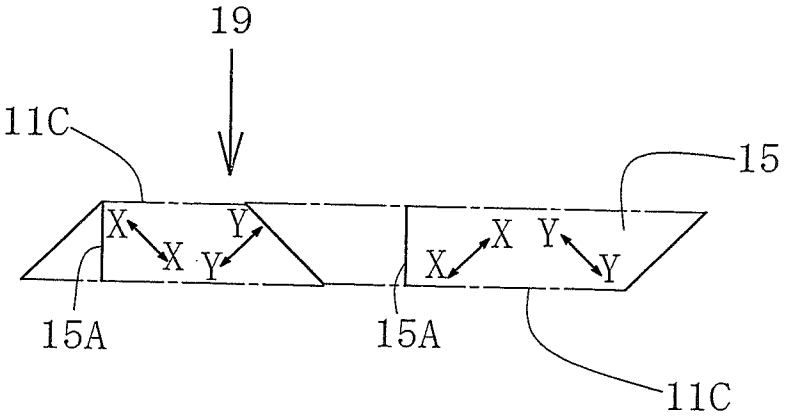
Figure 13:
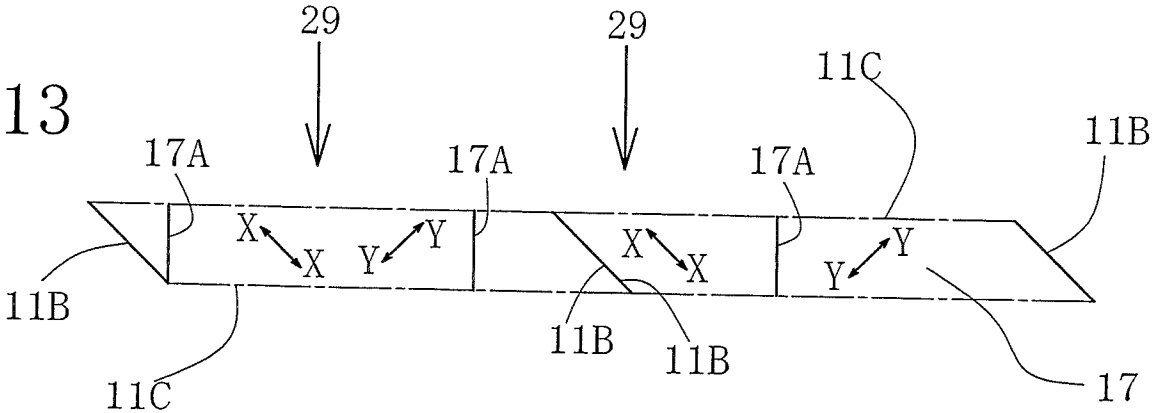

Subsequently, the joined board 15 is cut by a circular saw (not shown) along lines 15A extending perpendicularly to the parallel opposite long sides of the board 15 indicated by 11C at any desired spaced interval into a plurality of cut boards 19 of diagonal plywood each having a rectangular shape, as shown in FIG. 12. Similarly, the joined board 17 is also cut along lines 17A extending perpendicularly to the parallel opposite long sides of the board 17 indicated by 11C at any desired spaced interval into a plurality of cut boards 29 of diagonal plywood each having a rectangular shape, as shown in FIG. 13. As indicated by double-headed arrows X-X and Y-Y in FIGS. 12 and 13, the wood grains of component veneer sheets of the diagonal plywood boards 19 and 29 extend at an angle of about 45° with respect to the respective parallel opposite long sides of the plywood boards 19 and 29 and intersect each other at an angle of 90°.

It is noted that, for ease of understanding of the present invention, the parallel opposite sides of the cut plywood boards such as 13A through 13D in FIG. 9, of the joined elongated boards 15, 17 in FIGS. 10, 11 and of the cut boards 19, 20 of diagonal plywood in FIGS. 12, 13 are shown by dashed-dotted lines that corresponds to the cutting lines 11C in FIG. 9.

The method of manufacturing diagonal plywood according to the second embodiment of the present invention is also advantageous in that plywood boards produced by the existing machinery and equipment may be used, with the result that the cost for manufacturing diagonal plywood can be reduced greatly as compared to the case of the above-cited prior art method.

The present invention may be modified in various ways within the scope of the invention, as exemplified below.

A plywood board such as the board 1 of FIG. 1 having the wood grain of the face and back veneer sheets 1A and 1E thereof extending along the long side 2A of the board 1, may be used or cut diagonally, as shown in FIG. 9, for manufacturing of diagonal plywood. Conversely, a plurality of plywood boards such as 11 of FIG. 9 having the wood grain of the face and back veneer sheets extending across the long side 11B of the board 11 may be used or joined in a side-to-by manner to make the first joined elongated board such as 3 of FIG. 2.

Figure 14:
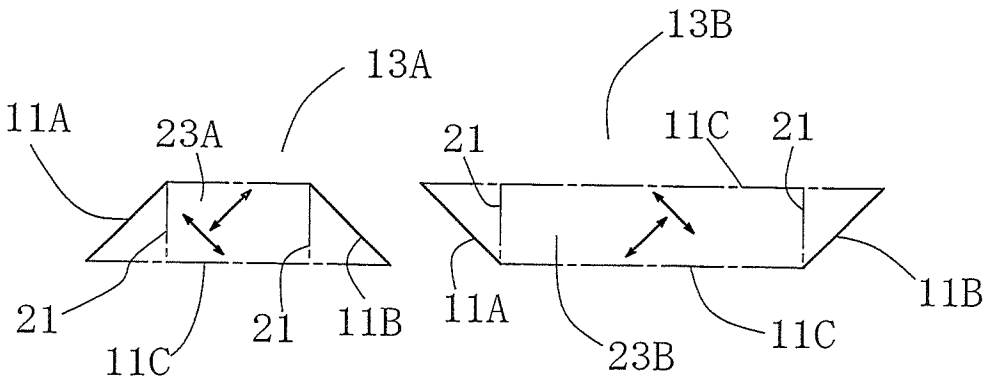
FIGS. 14 through 19 are schematic plan views showing various steps in the method for manufacturing diagonal plywood according to an embodiment modified over the second preferred embodiment of the present invention.
Figure 15:
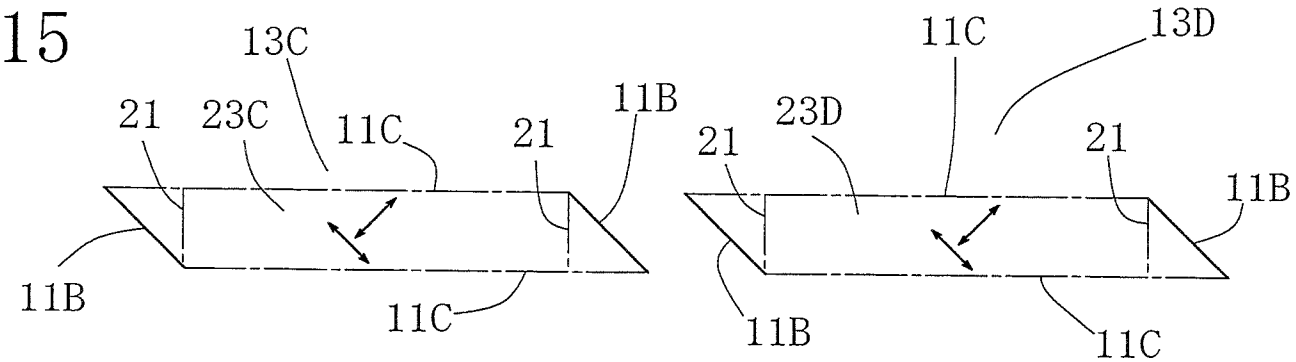
Figure 16:
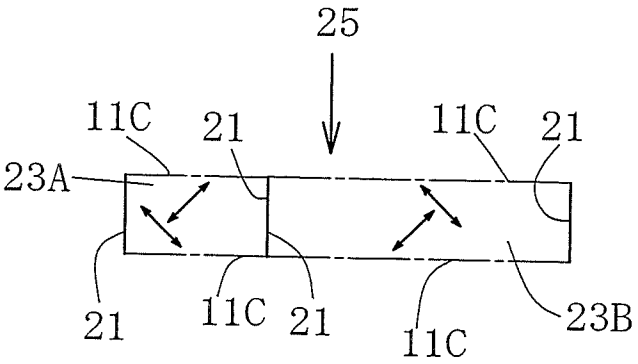
Figure 17:
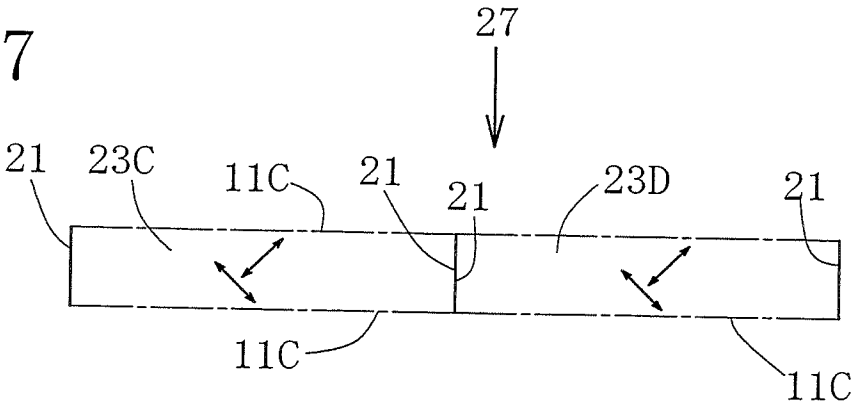
Figure 18:
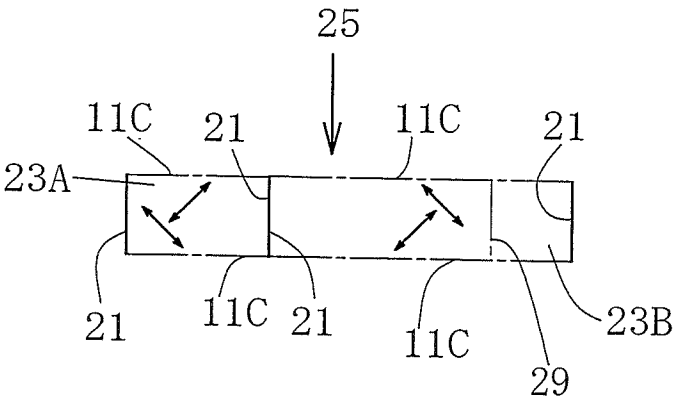
Figure 19:
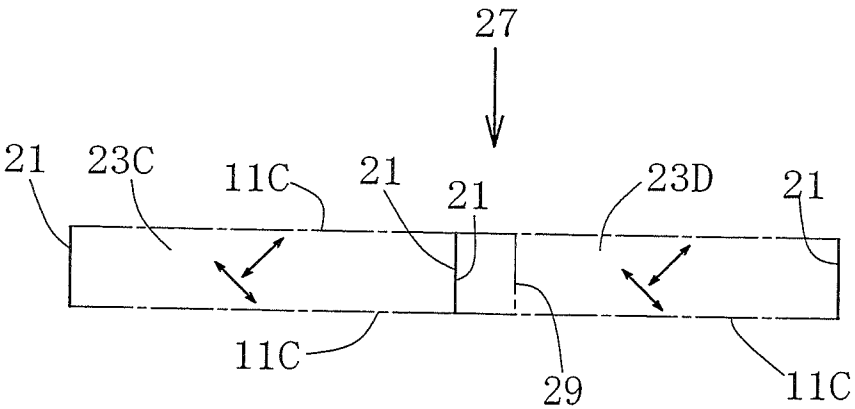
Figure 20:
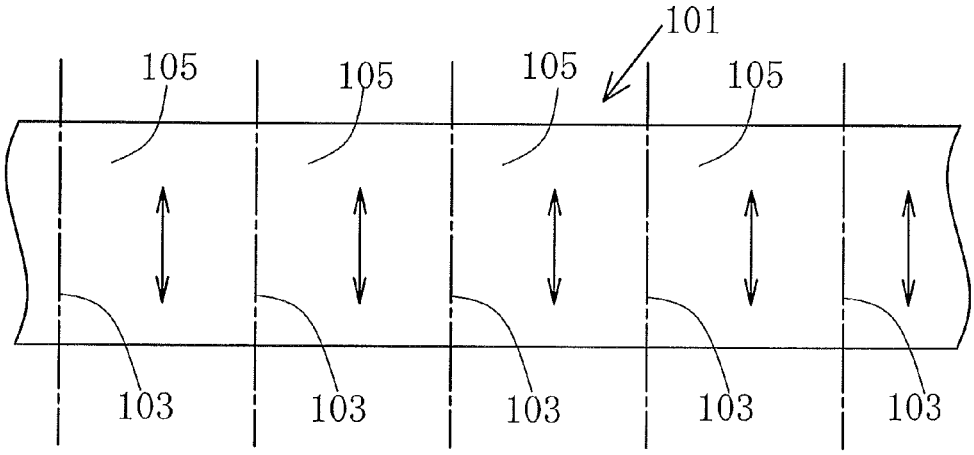
FIG. 20 PRIOR ART
FIGS. 20 through 22 are schematic views illustrating a method of manufacturing diagonal plywood according to a prior art.
Figure 21:
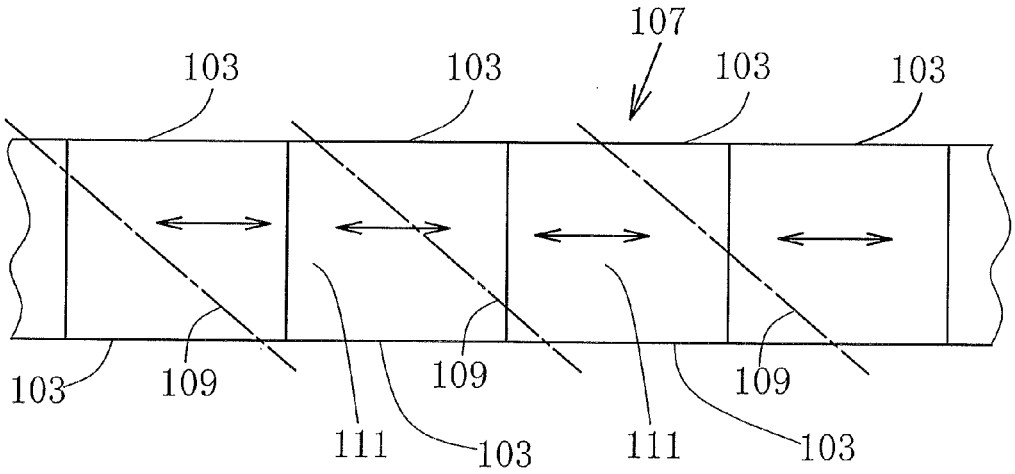
FIG. 21 PRIOR ART
Figure 22:
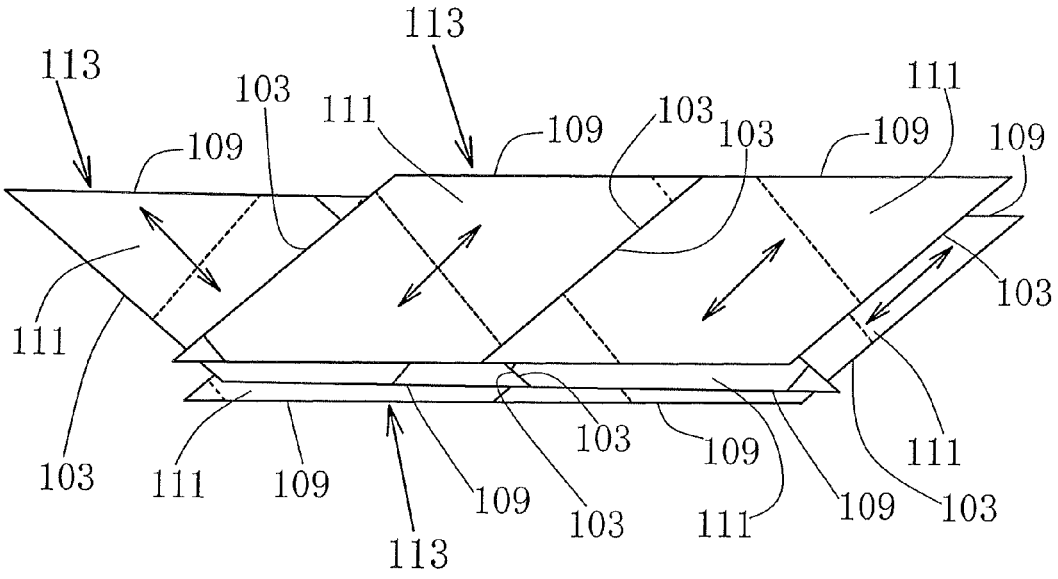
FIG. 22 PRIOR ART

Furthermore, the trapezoid-shaped boards 13A, 13B and the parallelograms-shaped boards 13C, 13D and so forth may be joined in a manner that is different from that illustrated in FIGS. 10 and 11. Referring to FIG. 14, the trapezoid cut boards 13A and 13B are cut along lines 21 that are perpendicular to the parallel opposite sides of the cut boards indicated by 11C into rectangular-shaped boards 23A and 23B, respectively, as shown in FIG. 14. Similarly, the parallelogram cut boards 13C and 13D are cut along lines 21 perpendicular to the parallel opposite sides of the cut boards indicated by 11C also into rectangular-shaped boards 23C and 23D, respectively, as shown in FIG. 15. The cutting lines 21 should preferably be set at such positions that permit production of rectangular boards each having maximum effective area, as shown in FIGS. 14 and 15. The rectangular boards 23A, 23B and 23C, 23D are then joined together at the sides thereof that are generated by the cutting of the trapezoid- and parallelogram-shaped boards 13A, 13B, 13C, 13D and indicated by 21, into joined elongated boards 25 and 27, respectively, as shown in FIGS. 16 and 17. As a matter of course, rectangular boards 23A, 23B, 23C, 23D may be joined together in any desired combination. As the last step of the method, the joined elongated boards 25, 27 are cut along lines 29 normal to the parallel long sides of the respective boards 25, 27, thereby producing a board of diagonal plywood having any desired length.

The aforementioned angle θ at which the plywood boards are cut diagonally in FIGS. 3 and 9 should preferably be between 30° and 60°.

Although the present invention has been described in detail for the purpose of illustration, it is to be understood that such detail is solely for that purpose and that variations can be made therein by those skilled in the art without departing from the scope of the invention.

What is claimed is:

1. A method for manufacturing diagonal plywood including:

cutting a plywood board having a rectangular shape with first two parallel sides and second two parallel sides and composed of a plurality of layers of veneer glued together, along lines extending diagonally with respect to the second parallel sides of the plywood board and spaced at an interval in a direction along the first parallel sides of the plywood board, into a plurality of cut boards with: first two parallel sides generated by the step of cutting the plywood board; and second two parallel sides corresponding to the second parallel sides of the plywood board;

sequentially joining the cut boards in a side-to-side manner at the first parallel sides thereof into a first joined elongated board with: the first parallel sides of the cut boards joined and aligned in a line; and sequentially cutting the first joined elongated board along lines extending perpendicularly to the first parallel sides of the first joined elongated board and spaced at any desired interval in another direction along the first parallel sides of the first joined elongated board.

2. The method for manufacturing diagonal plywood according to claim 1, further comprising: prior to the step of cutting the plywood board, providing a plurality of the plywood boards having a predetermined thickness and substantially the same structure; and sequentially joining the provided plywood boards in a side-to-side manner at the first sides thereof into a second joined elongated board with: the first parallel sides of the plywood boards joined in the second joined elongated board aligned with each other, respectively.

3. The method for manufacturing diagonal plywood according to claim 1, further comprising:

after the step of cutting the plywood board, cutting the cut boards along lines extending perpendicular to parallel sides thereof generated by the cutting of the plywood board, into a plurality of boards of a rectangular shape;

joining the cut rectangular-shaped boards in a side-to-side manner at sides thereof generated by the cutting of the cut boards into a third joined elongated board; and cutting the third elongated joined board along lines extending perpendicularly to elongated parallel sides thereof generated by the cutting of the plywood board and spaced at any desired interval in the direction along the elongated parallel sides of the third elongated joined board.

4. The method for manufacturing diagonal plywood according to claim 1, wherein said cut boards include a cut board having a parallelogram shape.

5. The method for manufacturing diagonal plywood according to claim 1, wherein said cut boards include a cut board having a trapezoid shape.

* * * * *